US009440440B2

(12) United States Patent
Date

(10) Patent No.: US 9,440,440 B2
(45) Date of Patent: Sep. 13, 2016

(54) LIQUID EJECTING APPARATUS AND LIQUID EJECTING MODULE

(71) Applicant: SEIKO EPSON CORPORATION, Tokyo (JP)

(72) Inventor: Kyohei Date, Nagano-shi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/940,816

(22) Filed: Nov. 13, 2015

(65) Prior Publication Data

US 2016/0136950 A1 May 19, 2016

(30) Foreign Application Priority Data

Nov. 17, 2014 (JP) ..... 2014-232589

(51) Int. Cl.
*B41J 2/14* (2006.01)

(52) U.S. Cl.
CPC ..... *B41J 2/14072* (2013.01); *B41J 2/14201* (2013.01); *B41J 2002/14491* (2013.01)

(58) Field of Classification Search
CPC ..... B41J 2/14072
See application file for complete search history.

(56) References Cited

U.S. PATENT DOCUMENTS 7,258,423 B2 * 8/2007 Nakamura ..... B41J 2/14201 29/830

FOREIGN PATENT DOCUMENTS

JP 2012-000834 A 1/2012

* cited by examiner

*Primary Examiner* — Geoffrey Mruk
(74) *Attorney, Agent, or Firm* — Foley & Lardner LLP

(57) ABSTRACT

A liquid ejecting apparatus includes a liquid ejecting unit that has an ejecting unit for ejecting liquid; a first wiring that transmits a driving signal for driving the ejecting unit to the liquid ejecting unit; a first connector that is provided in the liquid ejecting unit, and electrically connects the first wiring; a second wiring that transmits an ejecting control signal for controlling a supply of the driving signal to the ejecting unit to the liquid ejecting unit; and a second connector that is provided in the liquid ejecting unit, and electrically connects the second wiring, in which the liquid ejecting unit is located between the first connector and the second connector.

8 Claims, 13 Drawing Sheets

<DECODING CONTENTS OF DECODER>

| PRINTING DATA SI | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

MSB LSB

LIQUID EJECTING APPARATUS AND LIQUID EJECTING MODULE

The entire disclosure of Japanese Patent Application No. 2014-232589, filed Nov. 17, 2014 is expressly incorporated by reference herein.

BACKGROUND

1. Technical Field

The present invention relates to a liquid ejecting apparatus and a liquid ejecting module.

2. Related Art

A printing apparatus which prints an image or a document when an ejecting unit ejects liquid such as ink has been known. The ejecting unit typically includes a piezoelectric element such as a piezo element, and causes a nozzle to eject a predetermined amount of ink at a predetermined timing, when the piezoelectric elements are respectively driven according to a driving signal.

As a technology which is applied to such a printing apparatus, for example, a technology in which an ejecting control signal which controls an ejection operation of the ejecting unit, and a driving signal which drives the ejecting unit (piezoelectric element thereof) are supplied in a unit of a liquid ejecting head which is an aggregate of the ejecting unit has been known (refer to Japanese Patent No. 5354801).

In such a printing apparatus, it is necessary to perform printing at a high speed. In order to perform high speed printing, it is necessary to transmit the ejecting control signal and the driving signal to a liquid ejecting head at a higher speed (at high frequency).

Meanwhile, the ejecting control signal is a logic signal with a voltage of 3.3 V, for example, and in contrast, the driving signal is an analog signal with a voltage of at approximately 40 V, for example, and the signals have a relatively large current so as to sufficiently drive the piezoelectric element which is a capacitive element. For this reason, when there is an attempt to transmit the driving signal and the ejecting control signal at a higher speed, there is a problem in that the driving signal becomes a noise source, particularly, and easily has an adverse effect on the ejecting control signal.

SUMMARY

An advantage of some aspects of the invention is to provide a liquid ejecting apparatus and a liquid ejecting module in which an influence by a driving signal which becomes a noise source can be reduced when transmitting a driving signal and an ejecting control signal.

According to an aspect of the invention, there is provided a liquid ejecting apparatus including a liquid ejecting unit which has an ejecting unit for ejecting liquid; first wiring which transmits a driving signal for driving the ejecting unit to the liquid ejecting unit; a first connector which is provided in the liquid ejecting unit, and electrically connects the first wiring; second wiring which transmits an ejecting control signal for controlling a supply of the driving signal to the ejecting unit to the liquid ejecting unit; and a second connector which is provided in the liquid ejecting unit, and electrically connects the second wiring, in which the liquid ejecting unit is located between the first connector and the second connector.

According to the liquid ejecting apparatus, it is possible to reduce an influence due to a driving signal which becomes a noise source when the ejecting control signal and the driving signal are respectively transmitted at high frequencies, since the driving signal with a high voltage and a large-sized current, and the ejecting control signal which is a logic signal with a low voltage are supplied to the liquid ejecting unit by being separated.

In the liquid ejecting apparatus, it is preferable to adopt a configuration in which at least one of a first substrate which relays the first wiring and a second substrate which relays the second wiring is further included. In the configuration, it is possible to mount a conversion unit, a distribution unit, or the like, on the second substrate, for example.

The liquid ejecting apparatus may further include a plurality of the liquid ejecting units, in which the first substrate may supply the driving signal to each of the plurality of liquid ejecting units. Since the driving signal is supplied to each of the plurality of liquid ejecting units due to a relay of the first substrate, it is possible to avoid a configuration in which, in particular, wiring (leading around thereof) becomes complicated.

The liquid ejecting apparatus may further include the plurality of the liquid ejecting units, in which the second substrate may include a distribution unit which separates multiplexed ejecting control signals, and distributes the signals to each of the plurality of liquid ejecting units. Since the multiplexed ejecting control signals are separated, and are supplied to each of the plurality of liquid ejecting units using the distribution unit, it is possible to reduce the number of wiring in the previous stage of the distribution unit.

The liquid ejecting apparatus may further include a control unit which outputs a differential signal in which the ejecting control signal is converted, in which the second substrate may include a reception unit which receives the differential signal, and inversely converts the differential signal into the ejecting control signal. The reception unit of the second substrate receives the differential signal, and inversely converts the differential signal into the ejecting control signal. For this reason, it is possible to perform printing with high quality and high resolution since noise immunity in a flow path from the control unit to the second substrate can be improved, and a transmission rate of the ejecting control signal can be raised.

In addition, the invention can be realized in various aspects without being limited to the liquid ejecting apparatus, and the liquid ejecting apparatus can be considered as a single body of a liquid ejecting module, for example.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments for executing the invention will be described with reference to drawings.

Figure 1:
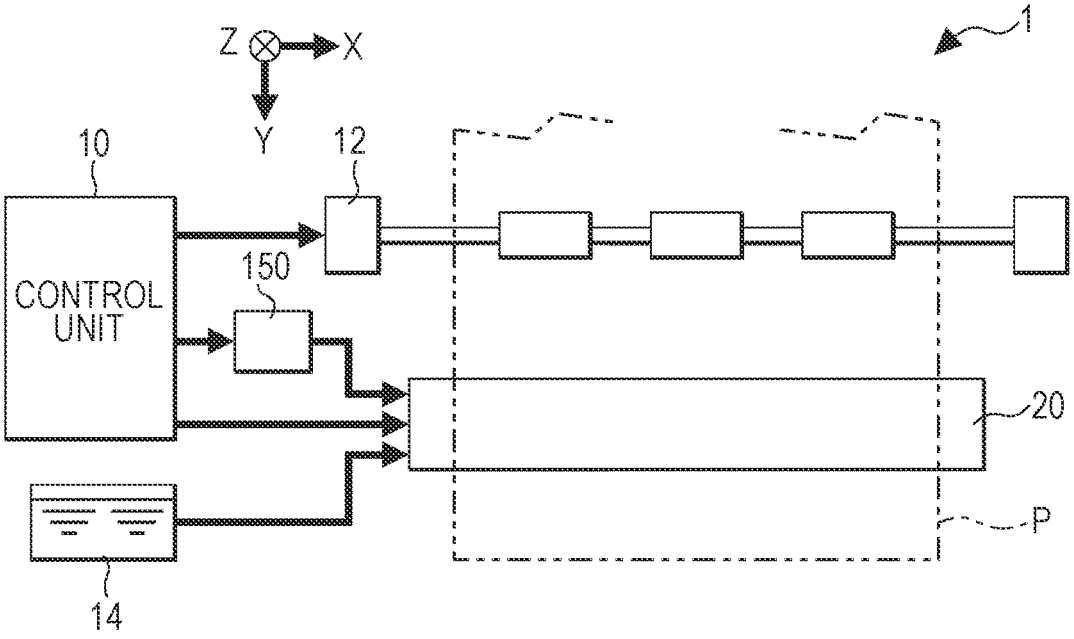
FIG. 1 is a diagram which illustrates a schematic configuration of a printing apparatus according to an embodiment.

FIG. 1 is a diagram which illustrates a schematic configuration of a printing apparatus 1 according to an embodiment.

The printing apparatus 1 is a printing apparatus (ink jet printer) which forms an ink dot group on a printing medium P such as paper by ejecting ink (liquid), and prints an image (including characters, figure, or the like) corresponding to image data in this manner.

As illustrated in the figure, the printing apparatus 1 includes a control unit 10, a transport mechanism 12, a liquid ejecting module 20, and a driving substrate 150. In addition, a liquid container (cartridge) 14 which stores ink of a plurality of colors is mounted on the printing apparatus 1. In the example, ink of four colors in total of cyan (C), magenta (M), yellow (Y), and black (Bk) are stored in the liquid reservoir 14.

As will be described later, the control unit 10 includes a control unit which mainly processes image data which is supplied from an external host computer, or controls each element of the printing apparatus 1, a transmission unit which transmits a signal output from the control unit, or the like. The transport mechanism 12 transports the printing medium P in the Y direction under a control of the control unit 10. The liquid ejecting module 20 ejects ink which is stored in the liquid container 14 onto the printing medium P under a control of the control unit 10. According to the embodiment, the liquid ejecting module 20 is a line head which is long in the X direction which intersects (typically orthogonal to) the Y direction. The driving substrate 150 generates and amplifies a driving signal, or the like, which will be described later, and supplies the signal to the liquid ejecting module 20 according to the control unit 10.

In the printing apparatus 1, an image is formed on the surface of the printing medium P when the liquid ejecting module 20 ejects ink onto the printing medium P in synchronization with transporting of the printing medium P using the transport mechanism 12.

In addition, hereinafter, a direction perpendicular to an X-Y plane (plane parallel to surface of printing medium P) is denoted by the Z direction. The Z direction is typically an ejecting direction of ink from the liquid ejecting module 20.

Figure 2:
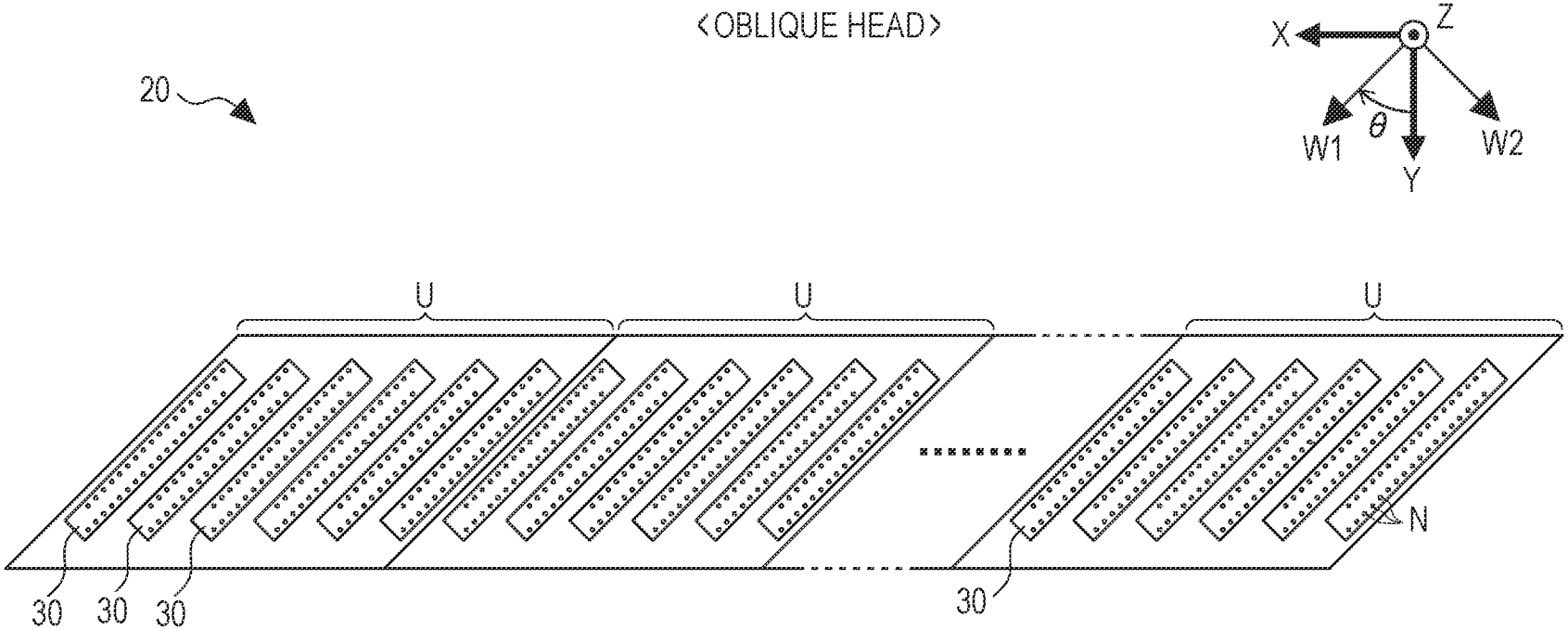
FIG. 2 is a plan view of a main part of a liquid ejecting module.

FIG. 2 is a plan view when the liquid ejecting module 20 is viewed from the printing medium P.

As illustrated in the figure, the liquid ejecting module 20 has a configuration in which a plurality of liquid ejecting units U as a basis are arranged along the X direction. The liquid ejecting unit U further includes a plurality of liquid ejecting heads 30 which are arranged along the X direction. The liquid ejecting head 30 includes a plurality of nozzles N which are inclined to the Y direction as a transport direction of the printing medium P, and are arranged in two columns.

In addition, in the embodiment, for ease of description, the number of liquid ejecting units U which configures the liquid ejecting module 20 is set to "6", and the number of liquid ejecting heads 30 which configure the liquid ejecting unit U is set to "6". For this reason, a total number of the liquid ejecting head 30 in the liquid ejecting module 20 is "36".

In addition, the liquid ejecting module 20 includes an aggregate substrate and a relay substrate which will be described later, in addition to the six liquid ejecting units U.

Figure 3:
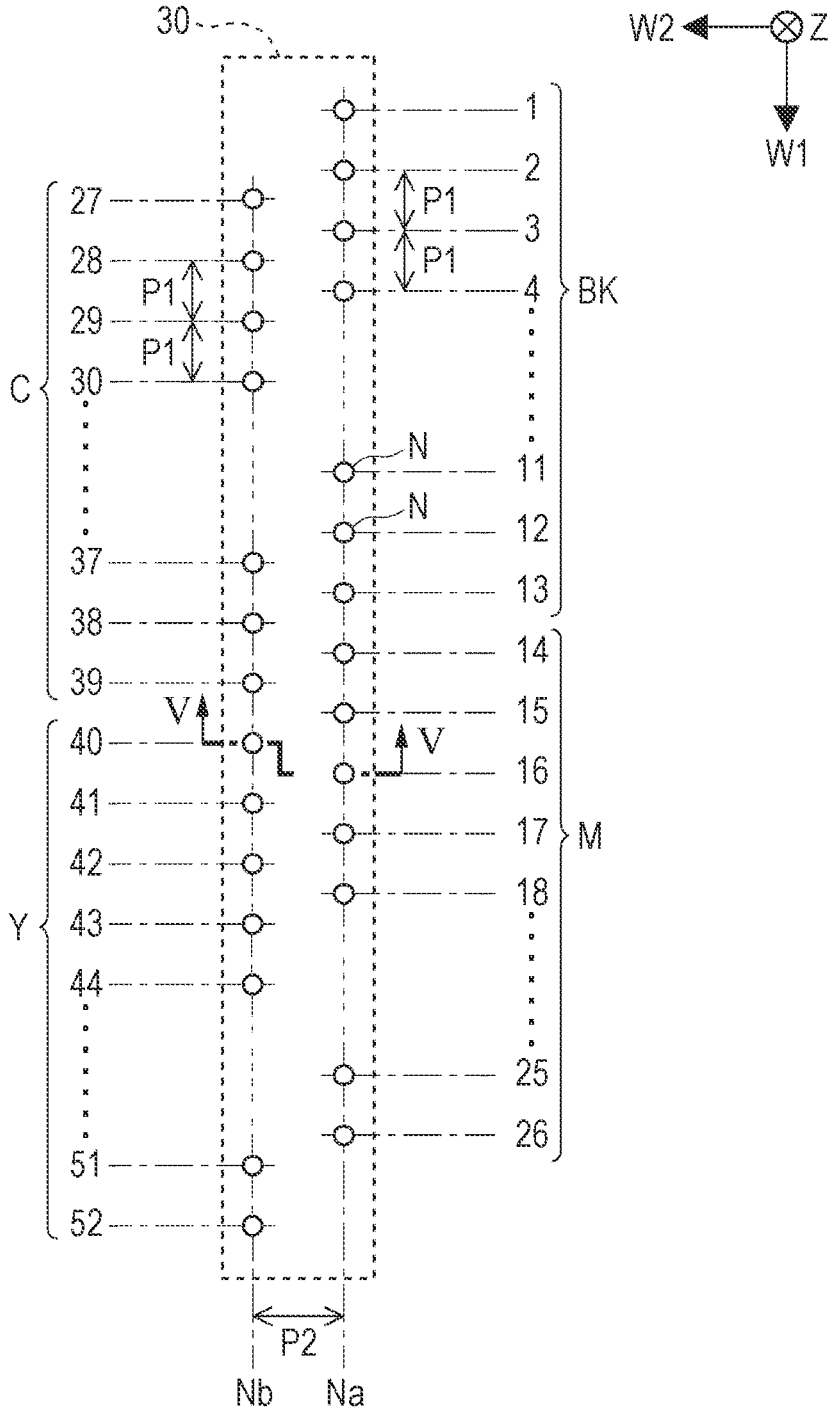
FIG. 3 is an exploded perspective view of a liquid ejecting unit.

FIG. 3 is a diagram which describes an arrangement of the nozzle N in the liquid ejecting head 30, and is a diagram when seen through from the opposite side to the printing medium P to an ejecting direction of ink, differently from FIG. 2. As described above, one liquid ejecting head 30 includes a plurality of nozzles N of two columns which are inclined; however, here, a nozzle arrangement in a single body of the liquid ejecting head 30 in which an inclination is not taken into consideration will be described first.

As illustrated in the figure, the nozzles N of the liquid ejecting head 30 are classified into nozzle columns Na and Nb. In the nozzle columns Na and Nb, the respective plurality of nozzles N are arranged at a pitch P1 along the W1 direction. In addition, the nozzle columns Na and Nb are separated by a pitch P2 in the W2 direction which is orthogonal to the W1 direction. Nozzles N which belong to the nozzle column Na, and nozzles N which belong to the nozzle column Nb are in a relationship of being shifted by a half of the pitch P1 in the W1 direction.

In FIG. 3, nozzle numbers for specifying the nozzles N hereinafter are illustrated. In the example, 1, 2, . . . , 25, and 26 are sequentially applied to the nozzle column Na as nozzle numbers from a nozzle N which is located at an end portion on the negative side (higher side in figure) in the W1 direction. For the nozzle column Nb, as serial numbers, 27, 28, . . . , 51 and 52 are applied as nozzle numbers from a nozzle N which is located at an end portion on the negative side (higher side in figure) in the W1 direction.

In FIG. 3, a correlation with ink colors which are ejected from the nozzle N is also illustrated. In the example, nozzles N from nozzle numbers "1" to "13" correspond to black (Bk), nozzles N from nozzle numbers "14" to "26" correspond to magenta (M), nozzles N from nozzle numbers "27" to "39" correspond to cyan (C), and nozzles N from nozzle numbers "40" to "52" correspond to yellow (Y).

In addition, in FIG. 3, the number of nozzles N is set to "52"; however, this is merely an example.

Figure 4:
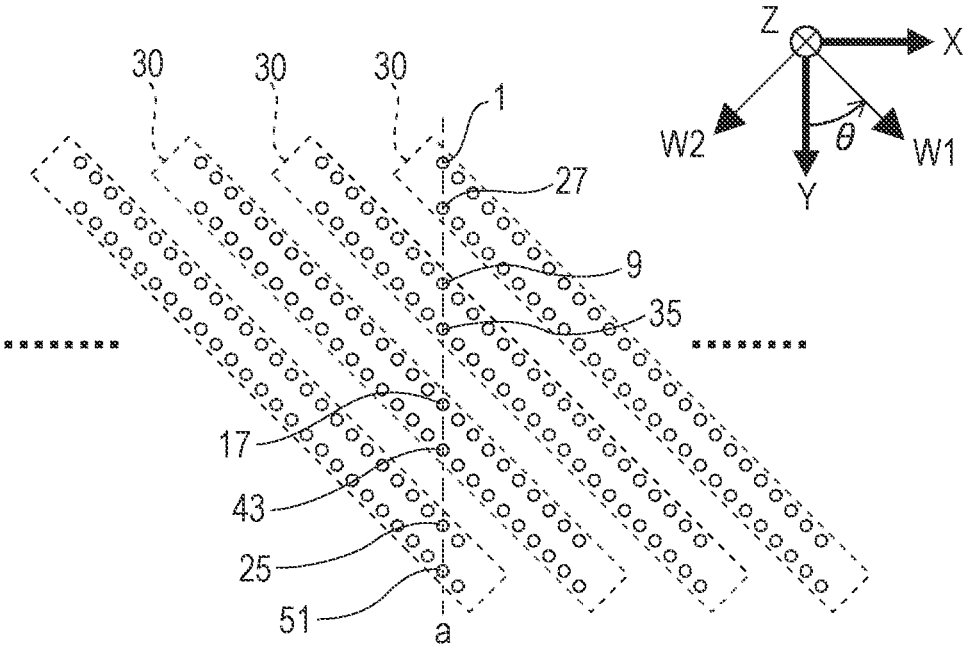
FIG. 4 is a diagram which illustrates a nozzle arrangement in a liquid ejecting head.

FIG. 4 is a diagram which illustrates a positional relationship between nozzles N when the liquid ejecting head 30 is arranged by being inclined, and illustrates a case when seen through from the opposite side to the printing medium P to the ejecting direction of ink, similarly to FIG. 3. For this reason, in FIGS. 2 and 4, it should be noted that inclined directions are reversed in FIGS. 2 and 4.

As illustrated in FIG. 4, the liquid ejecting head 30 is arranged by being inclined to the Y direction which is a transport direction of the printing medium P at an angle θwhich is non-parallel and non-orthogonal. At this time, in the example in the figure, positions (coordinates) of the nozzle N which belongs to the nozzle column Na and the nozzle N which belongs to the nozzle column Nb in the X direction are common.

For example, when focusing on the liquid ejecting head 30 on a right end in the figure, in one nozzle N which is located at a negative end portion in the W1 direction (nozzle N of which nozzle number is "1") in the nozzle column Na, and in one nozzle N which is located at a negative end portion in the W1 direction (nozzle N of which nozzle number is "27") in the nozzle column Nb in the focused liquid ejecting head 30, an angle θ is set so that the nozzles N pass through a virtual line a which extends in a direction parallel to the Y direction.

In addition, a liquid ejecting head 30 in the vicinity of the focused liquid ejecting head 30 is in the following positional relationship with the focused liquid ejecting head. That is, in a liquid ejecting head 30 which neighbors the focused liquid ejecting head 30 on the second left side of in the figure, a nozzle N with a nozzle number "17", and a nozzle N with a nozzle number "43" are in a positional relationship in which the nozzles pass through the virtual line a.

For this reason, when the printing medium P is transported in the Y direction, it is possible to form color dots by causing ink of black (Bk) which is ejected from the nozzle N with the nozzle number "1", and ink of cyan (C) which is ejected from the nozzle N with the nozzle number "27" in a certain liquid ejecting head 30, and ink of magenta (C) which is ejected from the nozzle N with the nozzle number "17", and ink of yellow (Y) which is ejected from a nozzle N with a nozzle number "43" in a liquid ejecting head 30 which is neighboring the focused liquid ejecting head 30 on the second left side to land in approximately the same position.

In addition, the positional relationship of passing through the above described virtual line a is also formed with respect to a nozzle N with a nozzle number "9" of a liquid ejecting head 30 which is neighboring the focused liquid ejecting head 30 on the first left side, a nozzle N with a nozzle number "35", a nozzle N with a nozzle number "25" of a liquid ejecting head 30 which is neighboring the focused liquid ejecting head 30 on the third left side, and a nozzle N with a nozzle number "51". For this reason, since two nozzles N of each color are overlapped with each other on the virtual line a, for example, a process in which ink is ejected only from a nozzle N which is located on the upstream side, and ejecting of ink from a nozzle N which is located on the downstream side is limited is performed.

In addition, in FIG. 4, only nozzle numbers which pass through the virtual line a are illustrated; however, positions in the X direction of nozzles N with nozzle numbers "2" and "28" in the focused liquid ejecting head 30, for example, and nozzles N with nozzle numbers "18" and "44" in a liquid ejecting head 30 which is neighboring the focused liquid ejecting head 30 on the second left side are common, and have configuration through which nozzles of four colors pass when viewed along the Y direction. The same positional configuration is formed with respect to other nozzles.

Figure 5:
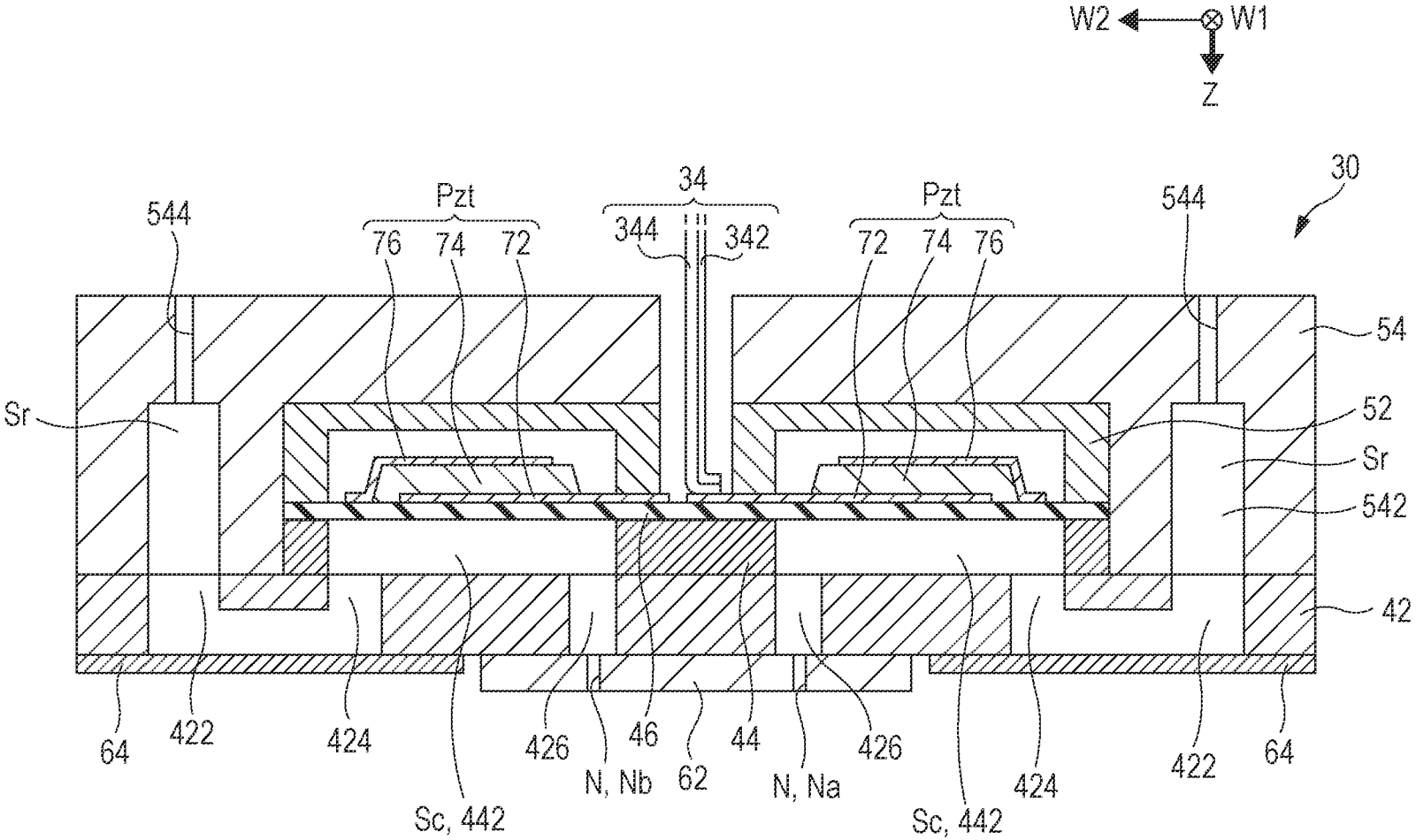
FIG. 5 is a diagram which illustrates a nozzle arrangement in the liquid ejecting head.

FIG. 5 is a sectional view which illustrates a structure of the liquid ejecting head 30. Specifically, FIG. 5 is a diagram which illustrates a section when cut in line V-V in FIG. 3 (section perpendicular to W1 direction, and is viewed from positive side to negative side in W1 direction).

As illustrated in FIG. 5, the liquid ejecting head 30 is a structure body (head chip) in which a pressure chamber substrate 44, a vibrating plate 46, a sealing body 52, and a support body 54 are provided on a plane on the negative side in the Z direction, and on the other hand, a nozzle plate 62 and a compliance unit 64 are provided on a plane on the positive side in the Z direction in the flow path substrate 42. Each element of the liquid ejecting head 30 is an approximately flat-plate shaped member which is long, and is fixed to each other using an adhesive, for example. In addition, the flow path substrate 42 and the pressure chamber substrate 44 are formed using a silicon single-crystal substrate, for example.

The nozzle N is formed on the nozzle plate 62. As is schematically described in FIG. 3, in the liquid ejecting head 30, a structure corresponding to the nozzle N in nozzle column Na, and a structure corresponding to the nozzle N in nozzle column Nb are shifted by a half of the pitch P1 in the W1 direction; however, since they are formed approximately symmetrically except for that point, hereinafter, the structure of the liquid ejecting head 30 will be described focusing on the nozzle column Na.

The flow path substrate 42 is a flat plate member which forms a flow path of ink, and an opening portion 422, a supply flow path 424, and a communication flow path 426 are formed on the flow path substrate. The supply flow path 424 and the communication flow path 426 are formed in each nozzle, and the opening portion 422 is formed so as to be continued over a plurality of nozzles which eject ink of the same color.

The support body 54 is fixed to the surface on the negative side in the Z direction of the flow path substrate 42. In the support body 54, an accommodation unit 542, and a guiding flow path 544 are formed. The accommodation unit 542 is an external concave portion (recession) corresponding to the opening portion 422 of the flow path substrate 42, and the guiding flow path 544 is a flow path which communicates with the accommodation unit 542.

A space which causes the opening portion 422 of the flow path substrate 42 and the accommodation unit 542 of the support body 54 to communicate functions as a liquid reservoir Sr. The liquid reservoir Sr is independently formed in each color of ink, and stores ink which passes through the liquid container 14 (refer to FIG. 1) and the guiding flow path 544. That is, four liquid reservoirs Sr corresponding to different ink are formed in the inside of one liquid ejecting head 30.

The compliance unit 64 is an element which configures a base of the liquid reservoir Sr, and suppresses (absorbs) a pressure change in ink in the liquid reservoir Sr and an internal flow path. The compliance unit 64 is configured by including a flexible member which is formed in a sheet shape, for example, and specifically, the compliance unit is fixed onto the surface of the flow path substrate 42 so that the opening portion 422 and each supply flow path 424 in the flow path substrate 42 are closed.

The vibrating plate 46 is provided on the surface of the pressure chamber substrate 44 on the side opposite to the flow path substrate 42. The vibrating plate 46 is a flat-plate shaped member which can elastically vibrate, and is configured by stacking an elastic film which is formed of an elastic material such as silicone oxide, and an insulating film which is formed of an insulating material such as zirconium oxide, for example. The vibrating plate 46 and the flow path substrate 42 face each other with an interval in the inside of each opening portion 442 of the pressure chamber substrate 44. A space which is interposed between the flow path substrate 42 and the vibrating plate 46 in the inside of each opening portion 442 functions as the pressure chamber Sc which applies a pressure to ink. Each pressure chamber Sc communicates with the nozzle N through the communication flow path 426 of the flow path substrate 42.

A piezoelectric element Pzt which corresponds to the nozzle N (pressure chamber Sc) is formed on the surface of the vibrating plate 46 on the side opposite to the pressure chamber substrate 44.

The piezoelectric element Pzt includes a driving electrode 72 which is individually formed in each piezoelectric element Pzt on the vibrating plate 46, a piezoelectric body 74 which is formed on a plane of the driving electrode 72, and a driving electrode 76 which is formed on a plane of the piezoelectric body 74. In addition, a region which faces the piezoelectric body 74 by interposing the piezoelectric body 74 using the driving electrodes 72 and 76 functions as the piezoelectric element Pzt.

The piezoelectric body 74 is formed in a process of including a heating process (baking), for example. Specifically, the piezoelectric body 74 is formed when a piezoelectric material which is applied onto the surface of the vibrating plate 46 on which a plurality of the driving electrodes 72 are formed is molded (for example, milling using plasma) in each piezoelectric element Pzt, after baking the piezoelectric material using the heating process in a baking furnace.

A part of the driving electrode 72 is exposed from the sealing body 52 and the support body 54, and to the exposed portion, one end of the wiring substrate 34 is fixed using an adhesive.

The wiring substrate 34 is formed by patterning a plurality of wiring 344 on a base film 342 which is insulative and flexible such as polyimide, and a semiconductor chip is mounted thereon, as will be described later. The driving electrode 72 has a configuration in which the driving electrode is electrically connected to the wiring 344 of the wiring substrate 34, and due to the connection, a voltage Vout of a driving signal is individually applied to one end of the piezoelectric element Pzt.

Meanwhile, though it is not illustrated, the driving electrodes 76 are commonly connected over the plurality of piezoelectric element Pzt, are led around from the sealing body 52 and the support body 54 to the exposed portion, and are electrically connected to separate wiring 344 in the wiring substrate 34. Due to the connection, constant voltages (for example, voltage $V_{BS}$ which will be described later) are commonly applied to the other end of the plurality of piezoelectric element Pzt.

In the piezoelectric element Pzt with such a configuration, center portions of all of the driving electrodes 72 and 76 and the vibrating plate 46 is bent upward or downward with respect to both end portions, with respect to the periphery in FIG. 5, according to a voltage which is applied to the driving electrodes 72 and 76. Specifically, the piezoelectric element Pzt has a configuration in which, when a voltage Vout of a driving signal applied through the driving electrode 72 becomes low, the piezoelectric element is bent upward, and in contrast, the piezoelectric element is bent downward, when the voltage Vout becomes high.

Here, when the piezoelectric element is bent upward, since an internal volume of the liquid reservoir Sr increases, ink is pulled in from the liquid reservoir Sr, and in contrast, when the piezoelectric element is bent downward, since the internal volume of the pressure chamber Sc decreases, ink droplets are ejected from the nozzle N depending on a degree of the decrease.

In this manner, when an appropriate driving signal is applied to the piezoelectric element Pzt, due to a displacement of the piezoelectric element Pzt, ink is ejected from the nozzle N. Accordingly, an ejecting unit which ejects ink is configured of an element which includes the pressure chamber Sc, the nozzle N, and the like, along with the piezoelectric element Pzt (ejecting unit in broad sense). However, there is a case in which the piezoelectric element Pzt is referred to as an ejecting unit in a narrow sense, since it can be considered that a target to be driven by a driving signal is the piezoelectric element Pzt to the utmost, and only the displacement of the piezoelectric element Pzt causes ink to be ejected.

Figure 6:
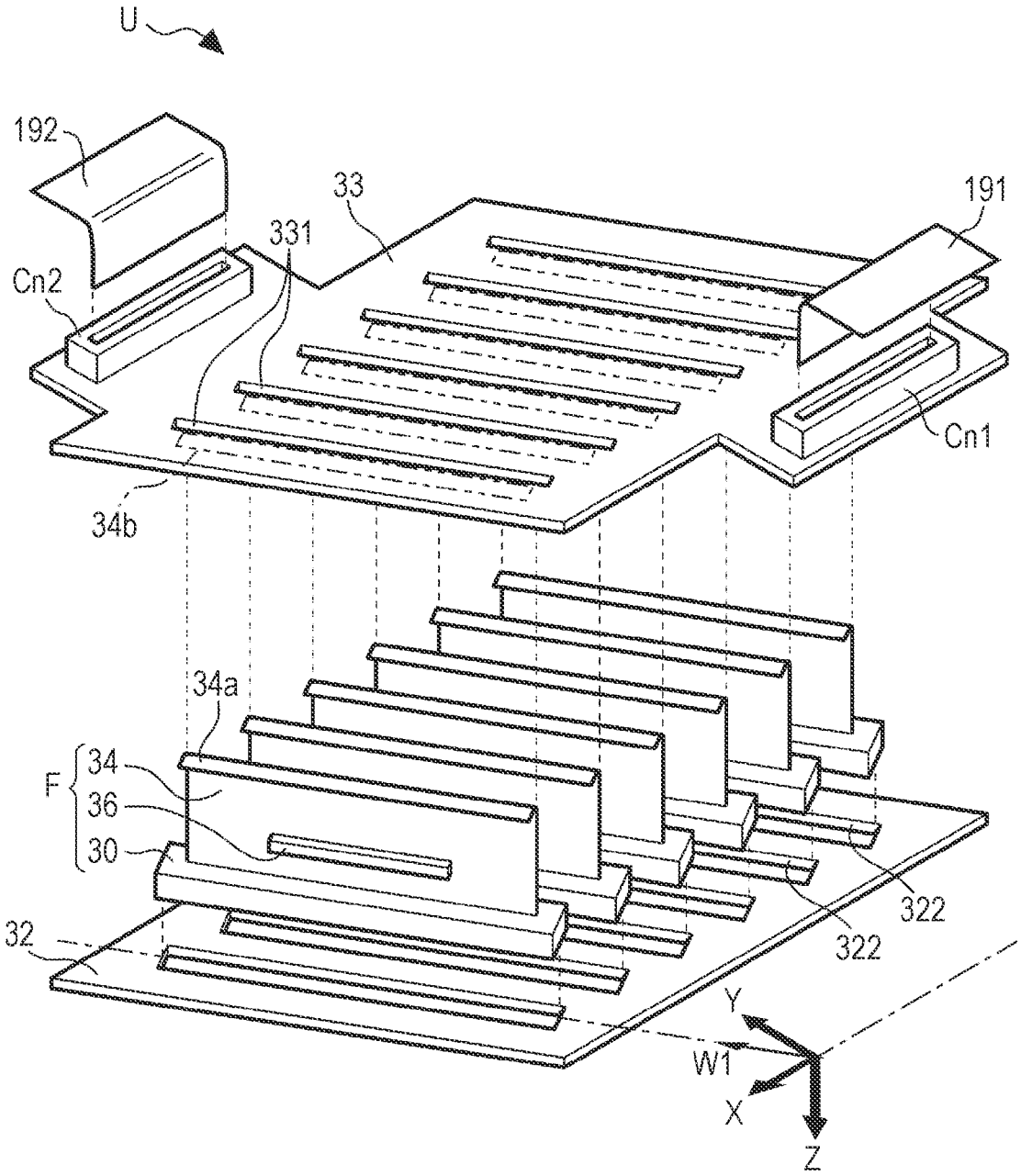
FIG. 6 is a sectional view of the liquid ejecting head.

FIG. 6 is an exploded perspective view which illustrates a configuration of one liquid ejecting unit U.

As illustrated in the figure, six opening portions 322 are formed on a flat-plate shaped fixed plate 32. Each of six liquid ejecting heads 30 are respectively fixed to the surface of the fixed plate 32 so that the nozzle N is exposed in the opening portion 322.

Six slits 331 are provided in the head substrate 33 so as to correspond to each of the liquid ejecting heads 30. The other end 34*a* of the wiring substrate 34 is inserted into the slit 331, and is connected to a terminal which is provided in a region 34*b* on a top face of the head substrate 33 using an adhesive or soldering.

A connector Cn1 (first connector) is provided on the positive side of the head substrate 33 in the Y direction, and a plurality of analog signals which will be described later are supplied through a flexible flat cable (FFC) 191 which is the first wiring. On the other hand, a connector Cn2 (second connector) is provided on the negative side of the head substrate 33 in the Y direction, and a plurality of digital signals which will be described later are supplied through a FFC 192 of the second wiring.

In the head substrate 33, wiring which guides the analog signal and the digital signal to a terminal which is provided in the region 34*b* (not illustrated) is patterned. For this reason, when the other end 34*a* of the wiring substrate 34 is connected to the region 34*b* of the head substrate 33, the analog signal which is supplied to the connector Cn1, and the digital signal which is supplied to the connector Cn2 are transmitted to the semiconductor chip 36 which is mounted on the wiring substrate 34.

In other words, in the liquid ejecting unit U, first, the analog signal and the digital signal are supplied to the liquid ejecting unit U in a state of being separated, that is, the analog signal is supplied from one side (upstream side in transport direction of printing medium P) with respect to the arrangement of the liquid ejecting head 30, and the digital signal is supplied from the other side (downstream side in transport direction of printing medium P) with respect to arrangement of the liquid ejecting head 30 when viewed planarly toward the Z direction, and secondly, the signals are supplied to the semiconductor chip 36 through the head substrate 33 and the wiring substrate 34.

In addition, for ease of descriptions, there is a case in which the liquid ejecting head 30, the wiring substrate 34, and the semiconductor chip 36 which is mounted on the wiring substrate 34 are inclusively referred to as a head block F. That is, the head block F which is referred to here is an assembly of an electrical functional block which includes the liquid ejecting head 30, the wiring substrate 34 which is connected to the liquid ejecting head 30, and the semiconductor chip 36 which is mounted on the wiring substrate 34.

Figure 7:
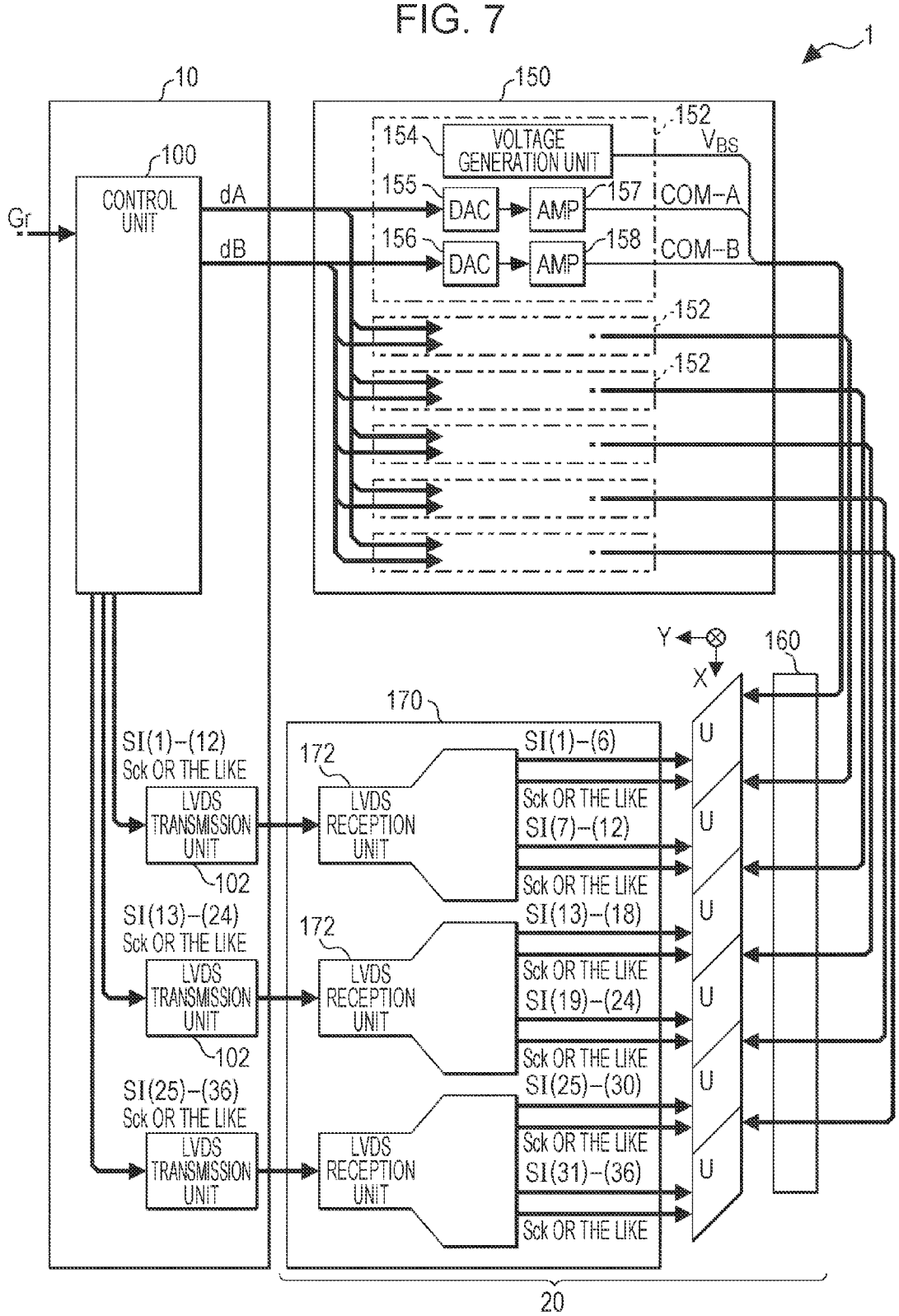
FIG. 7 is a block diagram which illustrates a functional configuration in the printing apparatus.

FIG. 7 is a block diagram which illustrates a functional configuration in the printing apparatus 1.

As described in FIG. 1, the printing apparatus 1 has a configuration in which the control unit 10, the liquid ejecting module 20, and the driving substrate 150 are included. Among these, the control unit 10 includes a control portion 100, and three transmission units 102. Schematically, the control unit 100 executes the following processes, or outputs a signal.

That is, first, the control portion 100 performs image processing such as a complementing process, an arrangement conversion process, or the like, by executing a predetermined program with respect to image data Gr which is supplied from a host computer (not illustrated), and then outputs the image data as printing data items SI(1) to SI(36).

In addition, the complementing process is a process in which, when there is a defective nozzle, for example, a dot to be formed due to the defective nozzle is formed using a nozzle which is present at the periphery of the defective nozzle, and the arrangement conversion process is a process for converting the image data Gr which defines an arrangement of pixels in rectangular coordinates, for example, into a coordinate system corresponding to an inclined arrangement of the nozzle N.

The printing data items SI(1) to SI(36) are data items which define dots to be formed on the printing medium P in one printing cycle in each liquid ejecting head 30. Here, when thirty-six liquid ejecting heads 30 are classified as 1, 2, 3, . . . , 35 and 36 in order from the negative side toward the positive side in the X direction, the numbers 1 to 36 in parentheses which follow the mark SI of the printing data denote that to which liquid ejecting head 30 the printing data is supplied. For example, the printing data SI(3) denotes that the data is supplied corresponding to the third liquid ejecting head 30, and the printing data SI(19) denotes that the data is supplied corresponding to the nineteenth liquid ejecting head 30.

As described above, the liquid ejecting unit U is configured of six liquid ejecting heads 30. For this reason, to the liquid ejecting units U of the first, the second, the third, the fourth, the fifth, and the sixth in order from the negative side toward the positive side in the X direction, printing data items SI(1) to SI(6), SI(7) to SI(12), SI(13) to SI(18), SI(19) to SI(24), SI(25) to SI(30), and SI(31) to SI(36) correspond.

Secondly, the control portion 100 outputs a clock signal Sck, and control signals LAT and CH in synchronization with the printing data items SI(1) to SI(36). In addition, as will be described later, since the printing data items SI(1) to SI(36), the clock signal Sck, and the control signals LAT and CH control a driving signal which is supplied to one end of the piezoelectric element Pzt, there is a case in which these are collectively referred to as the ejecting control signal. In addition, there is a case in which, in the ejecting control signal, the clock signal Sck, and the control signals LAT and CH except for the printing data items SI(1) to SI(36) are conveniently referred to as the clock signal Sck, or the like.

Thirdly, the control portion 100 outputs digital data items dA and dB in synchronization with the printing data items SI(1) to SI(36), the clock signal Sck, and the control signals LAT and CH. The data dA defines a waveform of a driving signal COM-A among driving signals which are supplied to the liquid ejecting head 30, and the data dB defines a waveform of a driving signal COM-B.

In addition to this, the control portion 100 controls transporting of the printing medium P in the Y direction by controlling the transport mechanism 12; however, a configuration for this will be omitted.

In addition, one transmission unit 102 performs multiplexing with respect to a single end digital signal of two printing data items of the liquid ejecting unit U, the clock signal Sck, and the control signals LAT and CH, and transmits the signal by converting the signal into a differential signal. As a transmission system of the differential signal, according to the embodiment, Low Voltage Differential Signaling (LVDS) is used.

Since the number of liquid ejecting units U is six in the embodiment, three transmission units 102 are used. That is, a first transmission unit 102 outputs a differential signal in which the printing data items SI(1) to SI(12), the clock signal Sck, and the like, are multiplexed corresponding to the first and second liquid ejecting units U, a second transmission unit 102 outputs a differential signal in which the printing data items SI(13) to SI(24), the clock signal Sck, and the like, are multiplexed corresponding to the third and fourth liquid ejecting units U, and a third transmission unit 102 outputs a differential signal in which the printing data items SI(25) to SI(36), the clock signal Sck, and the like, are multiplexed corresponding to the fifth and sixth liquid ejecting units U.

In addition, in the figure, three transmission units 102 are denoted as separate bodies; however, the transmission units may be integrated into one chip along with another function using a custom IC, or the like.

The liquid ejecting module 20 includes a relay substrate 160 and an aggregate substrate 170 in addition to the six liquid ejecting units U. Among these, the aggregate substrate 170 includes a reception unit 172 which also functions as three distribution units. The three reception units 172 perform, for example, one-to one correspondence to the transmission unit 102, respectively. One reception unit 172 inversely converts the multiplexed differential signal into a single end signal, and restores the multiplexed state (demultiplexing), that is, the reception unit separates the multiplexed differential signal into digital signals such as two printing data items of the liquid ejecting unit U, and the clock signal Sck, and supplies the signal to a corresponding liquid ejecting unit U.

In this manner, the clock signal Sck, and the control signals LAT and CH are supplied to the first, second, third, fourth, fifth, and sixth liquid ejecting units U along with printing data items SI(1) to SI(6), SI(7) to SI(12), SI(13) to SI(18), SI(19) to SI(24), SI(25) to SI(30), and SI(31) to SI(36) which correspond to respective liquid ejecting units U.

In this manner, it is possible to reduce the number of wiring of a cable which connects the control unit 10 and the aggregate substrate 170 by multiplexing the printing data, the clock signal Sck, and the like. In addition, it is possible to make the printing data, the clock signal Sck, and the like, strong in noise, and to transmit the data and signal at a high frequency by setting the data and signal to differential signals.

In addition, these digital signals have 0 voltages at an L level, and have 3.3 voltages at an H level. In addition, in the reception unit 172, a functional portion in which the received differential signal is inversely converted into a single end digital signal, and a demultiplexing portion in which the inversely converted digital signal is separated may be set to separate bodies.

The driving substrate 150 includes six driving circuits 152. The six driving circuits 152 perform one-to-one correspondence to the liquid ejecting unit U, respectively, for example. One driving circuit 152 includes a voltage generation unit 154, DA converters (DAC) 155 and 156, and amplification circuits (AMP) 157 and 158.

The voltage generation unit 154 generates a signal of voltage $V_{BD}$ which is commonly applied over the other ends of the plurality of piezoelectric elements Pzt. The DA converter 155 converts the digital data dA into an analog signal, and the amplification circuit 157 performs class-D amplification, for example, with respect to the analog signal, and outputs the amplified signal as the driving signal COM-A. Similarly, the DA converter 156 converts the data dB into an analog signal, and the amplification circuit 158 amplifies the analog signal, and outputs the signal as the driving signal COM-B. Here, for convenience, there is a case in which the driving signals COM-A and COM-B, and the signal of voltage $V_{BS}$ are referred to as driving signals, or the like.

The driving signals, or the like, which are output using the driving circuit 152 are supplied to a corresponding liquid ejecting unit U via the relay substrate 160.

In addition, since the common data dA and dB are supplied to the six driving circuits 152, respectively, waveforms of the driving signals COM-A and COM-B which are output from the six driving circuits 152 are also common to each other; however, in the example, they are set to be parallel in order to secure a driving capability.

Figure 8:
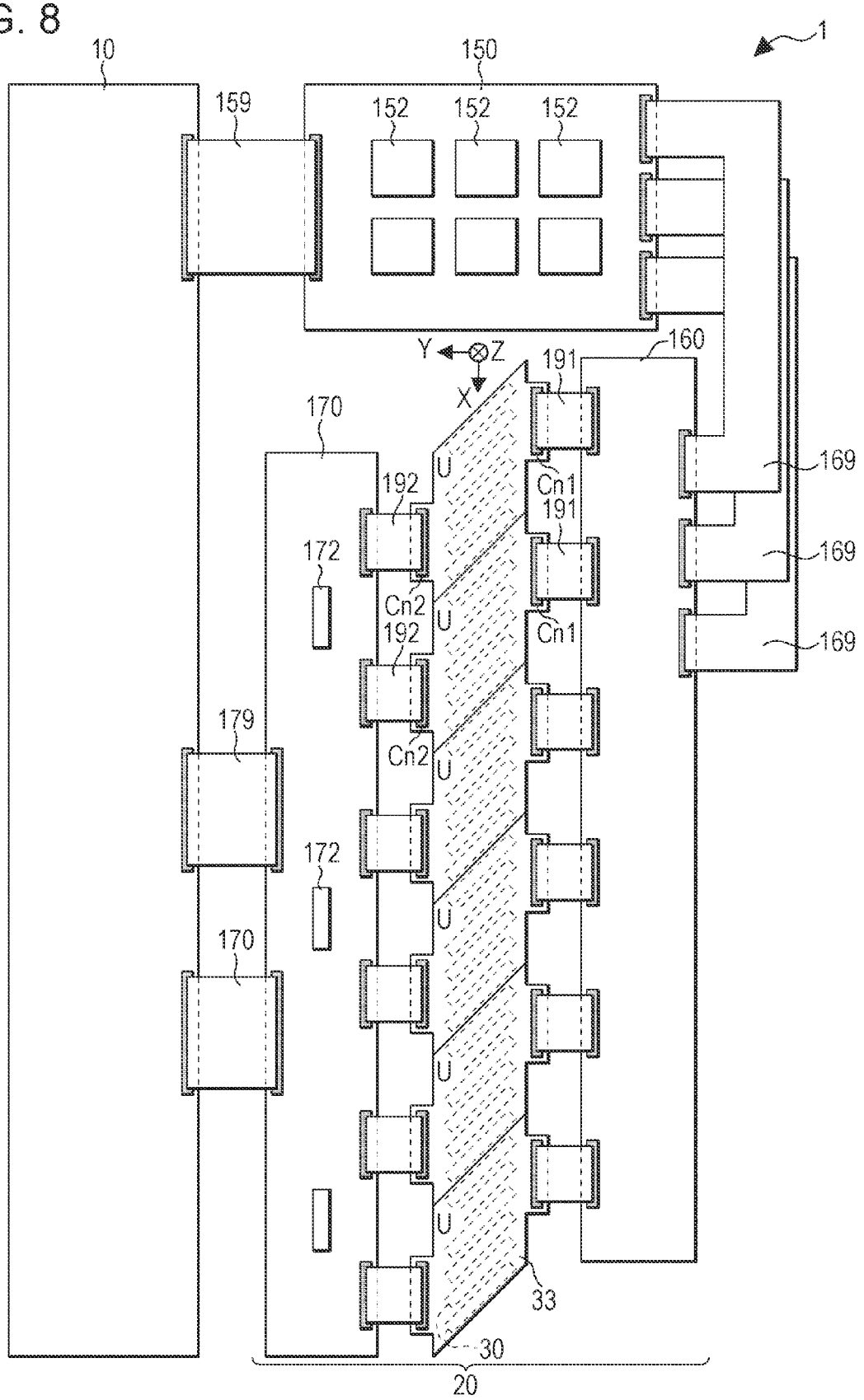
FIG. 8 is a diagram which illustrates a connection between each substrate in the printing apparatus.

FIG. 8 is a diagram which illustrates a connection of substrates in the printing apparatus 1.

As illustrated in the figure, the relay substrate 160 is located on the upstream side in the transport direction of the printing medium P, and the aggregate substrate 170 is located on the downstream side in the transport direction with respect to the liquid ejecting module 20 in which the six liquid ejecting units U are arranged in the X direction. In other words, the relay substrate 160 is arranged at one side, and the aggregate substrate 170 is arranged on the other side so as to interpose the liquid ejecting module 20 (liquid ejecting head 30) therebetween.

The control unit 10 supplies the data dA and dB to the driving substrate 150 through the FFC 159, and on the other hand, supplies the differential signal to the aggregate substrate 170 trough the FFC 179.

The driving signals, and the like, which are output from the six driving circuits 152, are supplied to the relay substrate 160 through an FFC 169 from the driving substrate 150. In the example, two sets of driving signals, and the like, are supplied to the relay substrate 160 through a set of the FFCs 169.

The relay substrate 160 rearranges the arrangement of six sets of driving signals which are supplied by three sets of the FFCs 169 in order to perform one-to-one correspondence to the six liquid ejecting units U. In addition, the driving signals, and the like, which are rearranged by the relay substrate 160 are supplied to one side of a corresponding liquid ejecting unit U through an FFC 191 and the connector Cn1.

In the aggregate substrate 170, the reception unit 172 receives a differential signal, inversely converts the signal into a single end signal, and separates the signal into two printing data items of the liquid ejecting unit U, and a clock signal Sck, and the like. The separated printing data and the clock signal Sck, and the like, are supplied to the other end side of a corresponding liquid ejecting unit U through an FFC 192 and the connector Cn2.

In this manner, the analog driving signal, and the like, are supplied from one side, and the printing data, the clock signal Sck, and the like are supplied from the other side to the liquid ejecting unit U so as to interpose the arrangement of the liquid ejecting head 30 therebetween.

Figure 9:
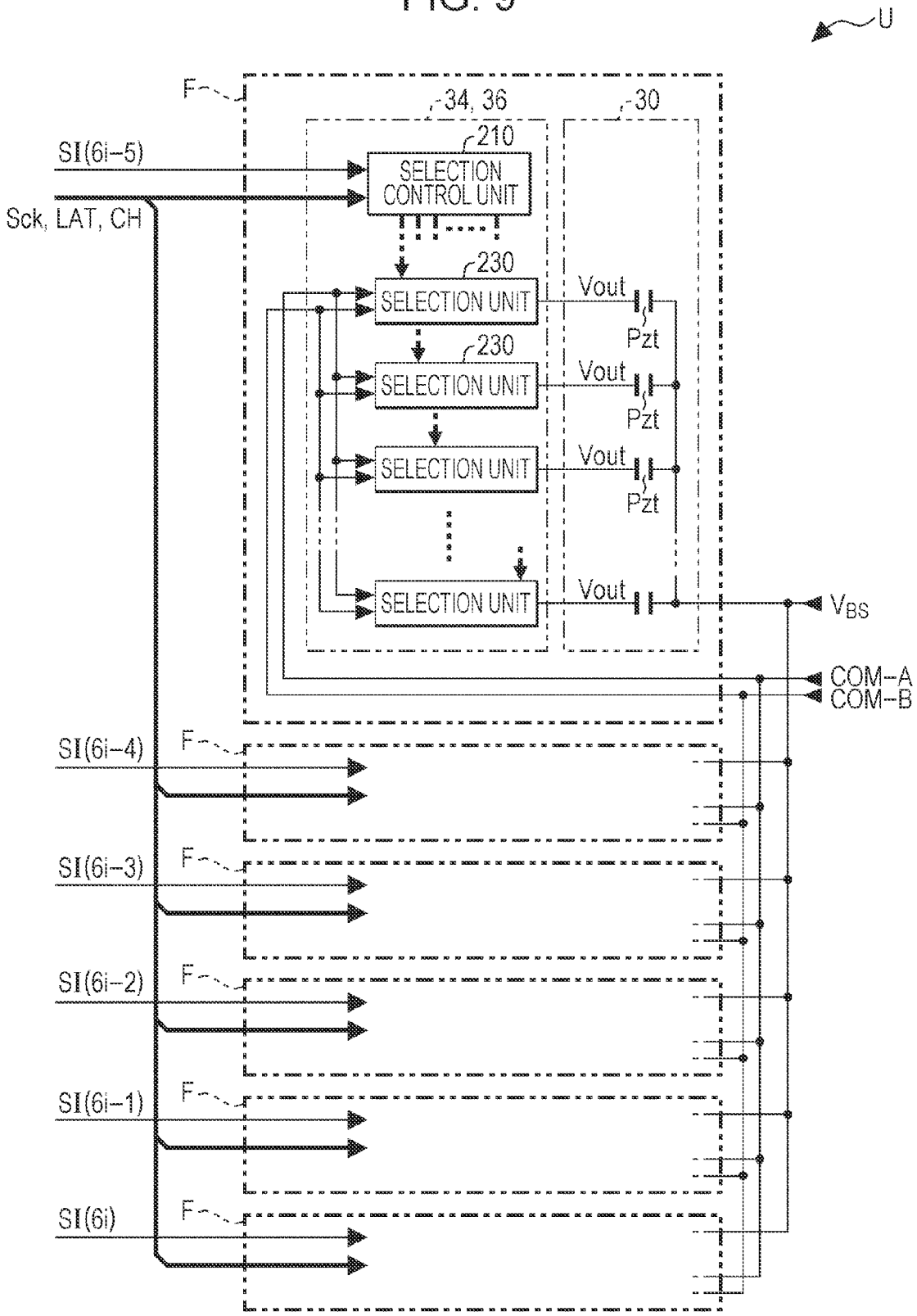
FIG. 9 is a block diagram which illustrates a functional configuration in the liquid ejecting head.

FIG. 9 is a diagram which illustrates an electric configuration of the liquid ejecting unit U. In addition, since configurations of the first to sixth liquid ejecting units U are the same as each other, here, the ith liquid ejecting unit U (i is integer of any of 1 to 6) will be described for convenience.

As described above, the liquid ejecting unit U is configured of six head blocks F in an electrical configuration, and one head block F is configured of the wiring substrate 34, the semiconductor chip 36, and the liquid ejecting head 30.

The semiconductor chip 36 which is mounted on the wiring substrate 34 of the head block F functionally includes the selection control unit 210 and a plurality of the selection units 230 which form a pair (a set) with the nozzle N. Meanwhile, the liquid ejecting head 30 is electrically configured of a plurality of the piezoelectric elements Pzt (26×2 columns=52 in example in FIG. 3, or the like).

Configurations of the six head blocks F are the same as each other in one liquid ejecting unit U, and the ith liquid ejecting unit U is configured of six liquid ejecting heads 30 of the (6i-5)th, the (6i-4)th, the (6i-3)th, the (6i-2)th, the (6i-1)th, and the (6i)th. The clock signal Sck, and the like, are supplied to the selection control unit 210 which corresponds to these liquid ejecting heads 30, in addition to supplying of printing data items SI(6i-5), SI(6i-4), SI(6i-3), SI(6i-2), SI(6i-1), and SI(6i) in order.

Since the configurations of the head blocks F are the same as each other, here, for convenience, the head block F which includes the (6i-5)th liquid ejecting head 30 will be described.

In the head block F, the selection control unit 210 distributes the printing data SI(6i-5) corresponding to each of the piezoelectric elements Pzt, and the selection unit 230 selects the driving signals COM-A and COM-B (or selects neither) corresponding to the distributed printing data, and supplies the driving signal to the driving electrode 72 (refer to FIG. 5) which is one end of the piezoelectric element Pzt.

In addition, in the figure, a voltage of the driving signal which is selected in the selection unit 230 is denoted by Vout so as to be distinguished from the driving signals COM-A and COM-B.

As described above, the voltage $V_{BS}$ is commonly applied to the other end in each piezoelectric element Pzt.

According to the embodiment, in one dot, four grayscales of a large dot, a middle dot, a small dot, and non-recording are expressed by ejecting ink maximum two times from one nozzle N. In order to express the four grayscales, according to the embodiment, two driving signals COM-A and COM-B are prepared, and the first-half pattern and the second-half pattern are included in each one cycle. In addition, in one cycle, the driving signals COM-A and COM-B are selected (or, are not selected) in the first half and the second half according to a grayscale to be expressed, and are supplied to the piezoelectric element Pzt.

Therefore, the driving signals COM-A and COM-B are described first, and then a configuration for selecting the driving signals COM-A and COM-B will be described.

Figure 10:
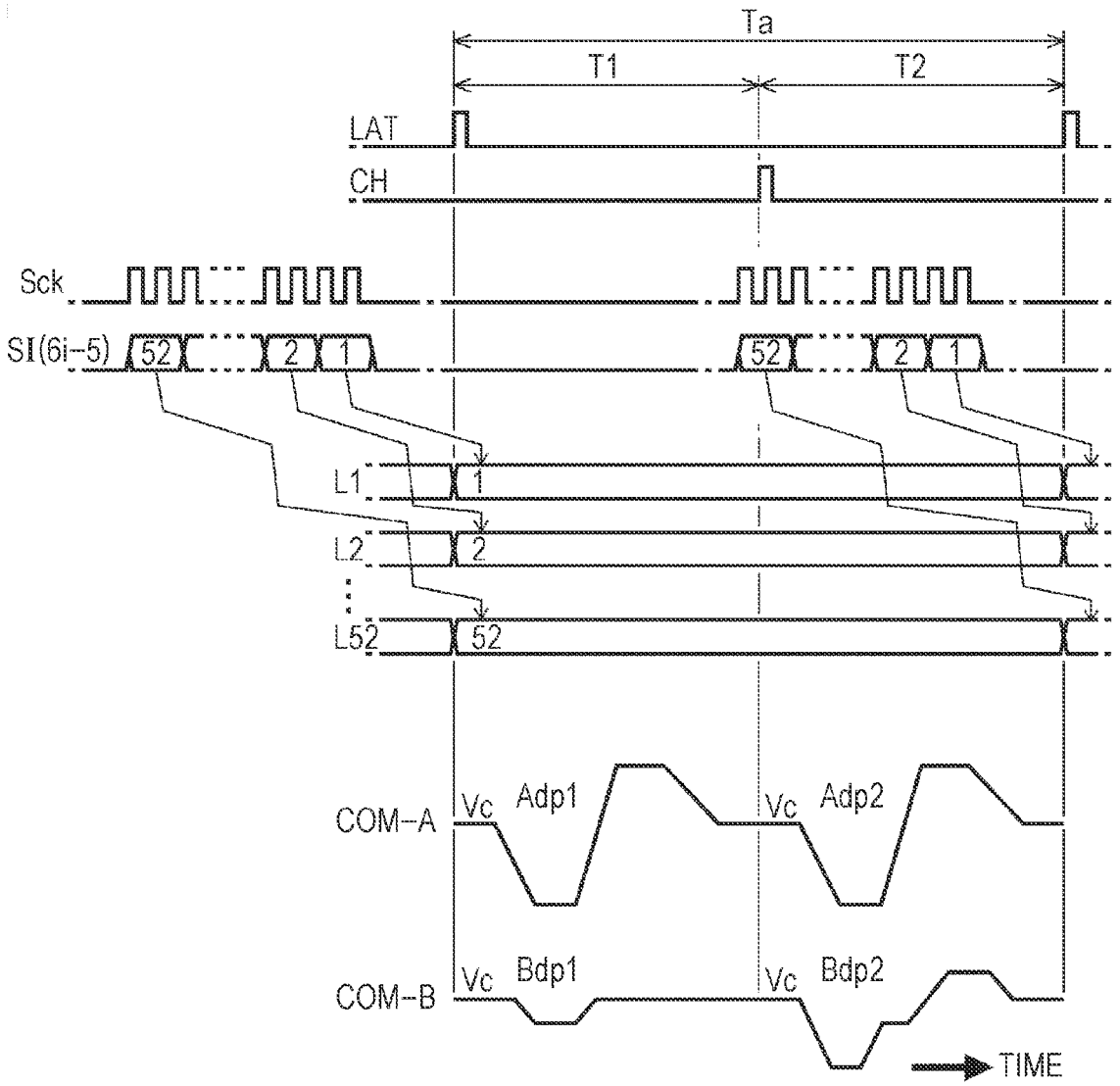
FIG. 10 is a diagram which describes operations of a selection control unit.

FIG. 10 is a diagram which illustrates waveforms, or the like, of the driving signals COM-A and COM-B.

As illustrated in the figure, the driving signal COM-A has a waveform in which a trapezoidal waveform Adp1 which is arranged in a period T1 from outputting of the control signal LAT (rising) to outputting of the control signal CH, and a trapezoidal waveform Adp2 which is arranged in a period T2 from outputting of the control signal CH to outputting of the subsequent control signal LAT are repeated in a printing cycle Ta.

According to the embodiment, the trapezoidal waveforms Adp1 and Adp2 have approximately the same waveform as each other, and are waveforms which cause ink of a predetermined amount, specifically, of a moderate amount to be ejected from a nozzle N corresponding to a piezoelectric element Pzt when it is assumed that the respective trapezoidal waveforms are supplied to one end of the piezoelectric element Pzt.

The driving signal COM-B has a waveform which repeats a trapezoidal waveform Bdp1 which is arranged in the period T1, and a trapezoidal waveform Bdp2 which is arranged in a period T2. The trapezoidal waveforms Bdp1 and Bdp2 according to the embodiment have waveforms different from each other. In these, the trapezoidal waveform Bdp1 is a waveform for preventing an increase in thickness of ink, by causing ink in the vicinity of an opening portion of the nozzle N to minutely vibrate. For this reason, even when it is assumed that the trapezoidal waveform Bdp1 is supplied to one end of a piezoelectric element Pzt, ink droplets are not ejected from a nozzle N which corresponds to the piezoelectric element Pzt. In addition, the trapezoidal waveform Bdp2 is a waveform which is different from the trapezoidal waveform Adp1 (Adp2). The trapezoidal waveform Bdp2 is a waveform which causes ink of an amount smaller than the above described predetermined amount to be ejected from a nozzle N corresponding to a piezoelectric element Pzt, when it is assumed that the trapezoidal waveform is supplied to one end of the piezoelectric element Pzt.

In addition, both voltages at a start timing of the trapezoidal waveforms Adp1, Adp2, Bdp1, and Bdp2 and voltages at an end timing are Vc, and are common. That is, the trapezoidal waveforms Adp1, Adp2, Bdp1, and Bdp2 are waveforms which start in the voltage Vc, respectively, and end in the voltage Vc.

In addition, a maximum value of a voltage of the trapezoidal waveform Adp1 is approximately 42 voltages.

Figure 11:
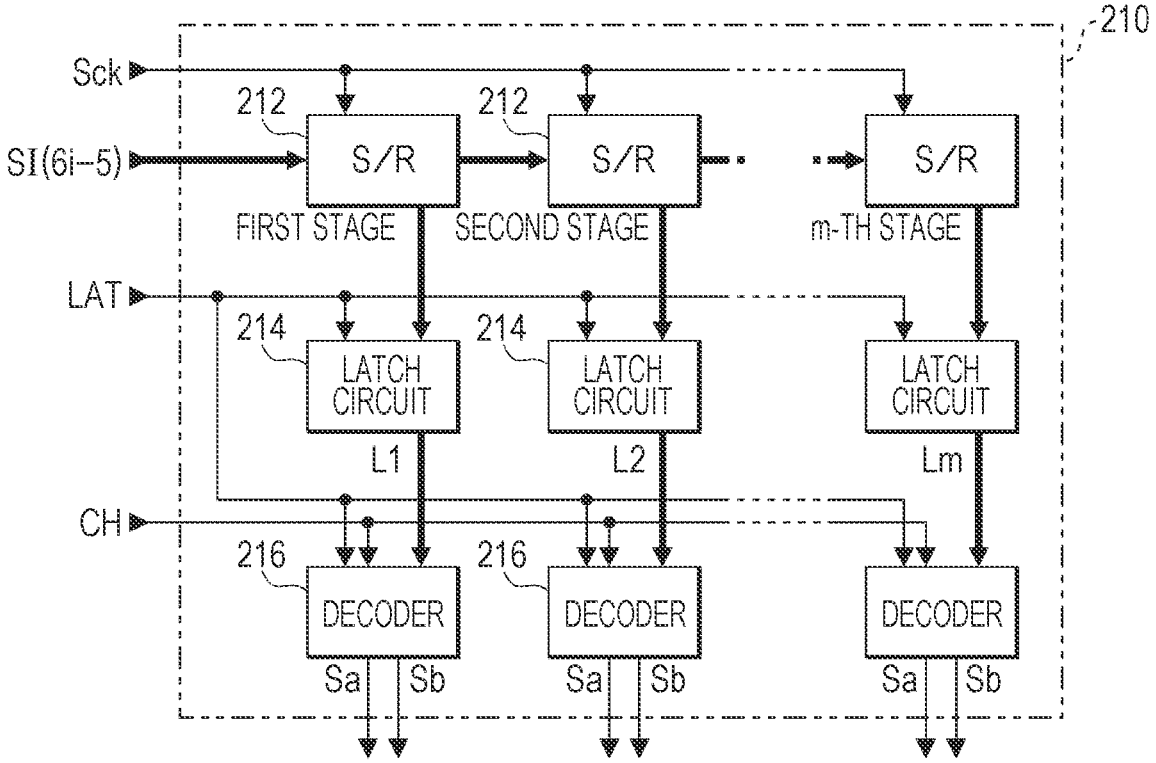
FIG. 11 is a diagram which illustrates a configuration of the selection control unit.

FIG. 11 is a diagram which illustrates a configuration of the selection control unit 210 in FIG. 9.

As illustrated in the figure, the clock signal Sck, the printing data SI(6i-5), and the control signals LAT and CH are supplied to the selection control unit 210. In the selection control unit 210, a group of a shift register (S/R) 212, a latch circuit 214, and a decoder 216 is provided corresponding to the respective piezoelectric elements Pzt (nozzle N).

The printing data SI(6i-5) is data which defines dots to be formed according to all of nozzles N (52 nozzles) of the (6i-5)th liquid ejecting head 30 in the printing cycle Ta. According to the embodiment, printing data of one nozzle is configured of two bits of a higher bit (MSB) and a lower bit (LSB) in order to express four grayscales of non-recording, a small dot, a middle dot, and a large dot.

The printing data (6i-5) is supplied to each nozzle N (piezoelectric element Pzt) in synchronization with the clock signal Sck in accordance with a transport of the printing medium P. The shift register 212 has a configuration for temporarily holding the printing data SI(6i-5) of two bits by corresponding to a nozzle N.

In detail, the printing data SI to which the shift registers 212 with the number of stages corresponding to the piezoelectric element Pzt (nozzle) are connected in a cascade, and which is supplied to the shift register 212 in the first stage which is located on the left end in the figure is sequentially transmitted to the rear stage according to the clock signal Sck.

In addition, according to the embodiment, the number of piezoelectric elements Pzt (nozzles) is set to "52". Here, in order to distinguish the shift registers 212, the shift registers are sequentially denoted by a first stage, a second stage, . . . , and a fifty-second stage from the upstream side to which the data SI(6i-5) is supplied.

The latch circuit 214 latches the printing data SI which is held in the shift register 212 in rising of the control signal LAT. In addition, since the printing data which is held in the shift register 212 is not printing data SI(6i-5) which denotes fifty-two nozzles, and is one nozzle, the mark is simply set to SI so as to avoid confusion.

The decoder 216 decodes the printing data SI of two bits which is latched using the latch circuit 214, outputs selection signals Sa and Sb in each of period T1 and T2 which is defined by the control signals LAT and CH, and defines a selection in the selection unit 230.

Figures 12, 13:
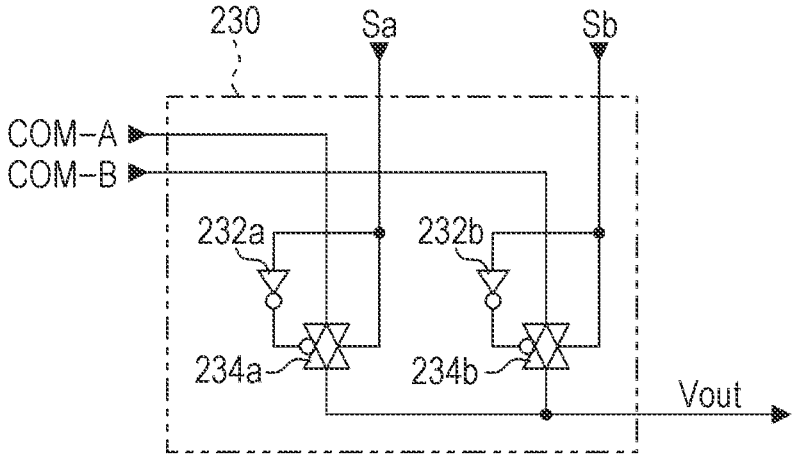
FIG. 12 is a diagram which illustrates decode contents of a decoder.
FIG. 13 is a diagram which illustrates a configuration of a selection unit.

FIG. 12 is a diagram which illustrates decode contents in the decoder 216.

In the figure, the latched printing data SI of two bits is denoted by (MSB, LSB). When the latched printing data SI is (0, 1), for example, it means that the decoder 216 outputs logic levels of the selection signals Sa and Sb in an H level and an L level in the period T1, respectively, and in the L level and the H level, respectively, in the period T2.

In addition, the logic levels of the selection signals Sa and Sb are shifted to high amplitude logic using a level shifter (not illustrated), not the clock signal Sck, the printing data SI, and the control signals LAT and CH.

FIG. 13 is a diagram which illustrates a configuration of the selection unit 230 in FIG. 9.

As illustrated in the figure, the selection unit 230 includes inverters (NOT circuits) 232*a* and 232*b*, and transfer gates 234*a* and 234*b*.

The selection signal Sa from the decoder 216 is supplied to a positive control end of the transfer gate 234*a* to which a circle is not attached, and meanwhile, the selection signal is subjected to logic inversion using the inverter 232*a*, and is supplied to the negative control end of the transfer gate 234*a* to which a circle is attached. Similarly, the selection signal Sb is supplied to a positive control end of the transfer gate 234*b*, and meanwhile, the selection signal is subjected to logic inversion using the inverter 232*b*, and is supplied to the negative control end of the transfer gate 234*b*.

The driving signal COM-A is supplied to an input end of the transfer gate 234*a*, and the driving signal COM-B is supplied to an input end of the transfer gate 234*b*. Output ends of the transfer gates 234*a* and 234*b* are connected in common, and are connected to one end of a corresponding piezoelectric element Pzt.

The transfer gate 234*a* causes the input end and the output end to be electrically connected (ON) therebetween, when the selection signal Sa is at the H level, and causes the input end and the output end to be not electrically connected (OFF) therebetween, when the selection signal Sa is at the L level. Similarly, the transfer gate 234*b* causes the input end and the output end to be turned on and off therebetween according to the selection signal Sb.

As illustrated in FIG. 10, the printing data SI (6i-5) is supplied in descending order of the nozzle number in synchronization with the clock signal Sck in each nozzle, and is sequentially transmitted in the shift register 212 corresponding to the nozzle. In addition, when supplying of the clock signal Sck is stopped, it enters a state in which printing data SI corresponding to a nozzle number is held in each of the shift registers 212.

Here, when the control signal LAT rises, the respective latch circuits 214 simultaneously latch the printing data SI which is held in the shift register 212. In FIG. 10, the number in L1, L2, . . . , L52 denotes a nozzle number of the printing data SI which is latched using the latch circuit 214 corresponding to the shift register 212 of the first stage, the second stage, . . . , and the fifty-second stage.

The decoder 216 outputs logic levels of the selection signals Sa and Sb with contents which are illustrated in FIG. 12 in each of the periods T1 and T2 according to a size of a dot which is defined in the latched printing data SI.

That is, first, when the printing data SI is (1, 1), and defines a size of a large dot, the decoder 216 sets the selection signals Sa and Sb to an H level and an L level in the period T1, and sets the signals to the H level and the L level also in the period T2. Secondly, when the printing data SI is (0, 1), and defines a size of a middle dot, the decoder 216 sets the selection signals Sa and Sb to the H level and the L level in the period T1, and sets the signals to the L level and the H level in the period T2. Thirdly, when the printing data SI is (1, 0), and defines a size of a small dot, the decoder 216 sets the selection signals Sa and Sb to the L level and the L level in the period T1, and sets the signals to the L level and the H level in the period T2. Fourthly, when the printing data SI is (0, 0), and defines non-recording, the decoder 216 sets the selection signals Sa and Sb to the L level and the H level in the period T1, and sets the signals to the L level and the L level in the period T2.

Figure 14:
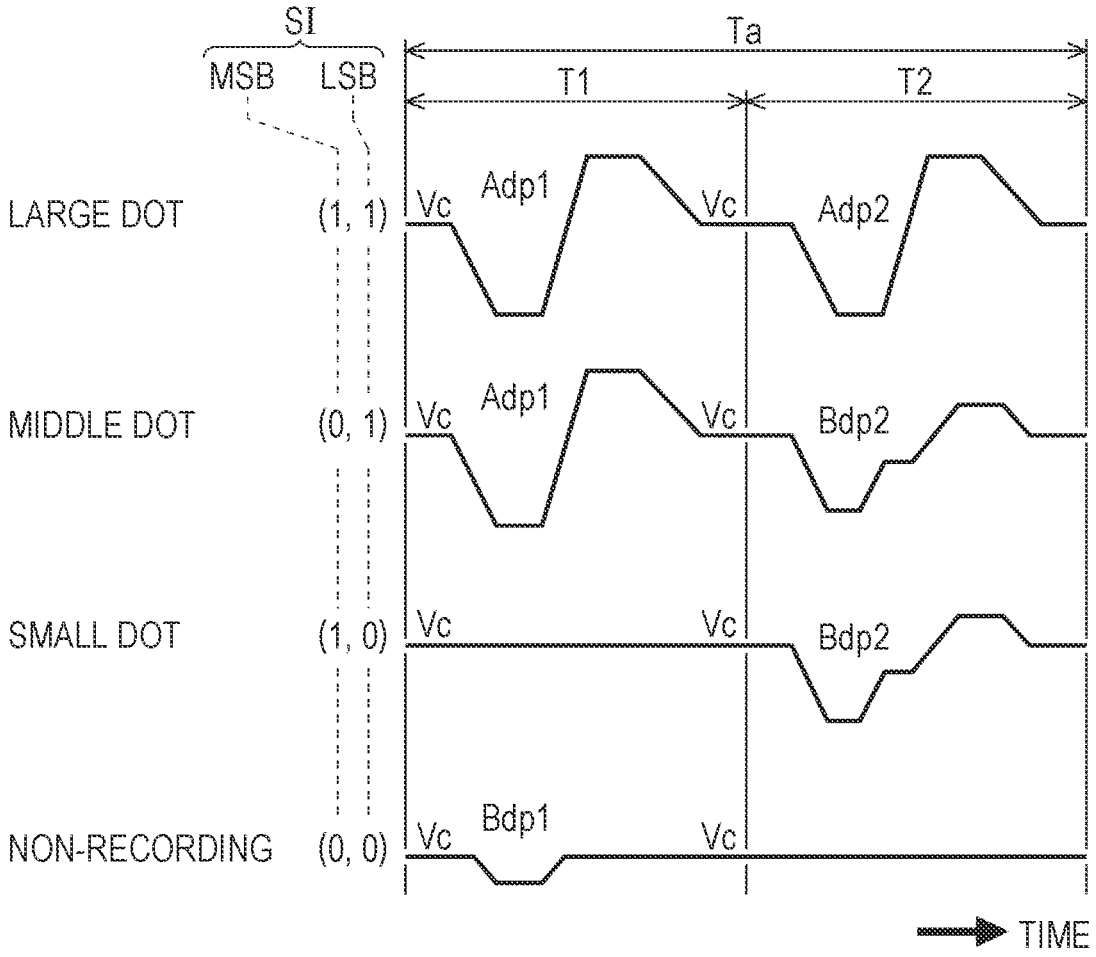
FIG. 14 is a diagram which illustrates an example of a waveform of a driving signal which is supplied to one end of a piezoelectric element.

FIG. 14 is a diagram which illustrates a waveform of a voltage of a driving signal which is selected according to printing data SI, and is supplied to one end of a piezoelectric element Pzt.

When the printing data SI is (1, 1), the selection signals Sa and Sb are set to the H level and the L level in the period T1, the transfer gate 234*a* is turned on, and the transfer gate 234*b* is turned off. For this reason, the trapezoidal waveform Adp1 of the driving signal COM-A is selected in the period T1. Since the selection signals Sa and Sb are set to the H level and the L level in the period T2, the selection unit 230 selects the trapezoidal waveform Adp2 of the driving signal COM-A.

In this manner, when the trapezoidal waveform Adp1 is selected in the period T1, the trapezoidal waveform Adp2 is selected in the period T2, and the waveforms are supplied to one end of the piezoelectric element Pzt as driving signals, a moderate amount of ink is ejected from a nozzle N corresponding to the piezoelectric element Pzt by being divided into two. For this reason, each ink lands on the printing medium P, and unites, and as a result, a large dot which is defined in the printing data SI is formed on the printing medium.

When the printing data SI is (0, 1), since the selection signals Sa and Sb are set to the H level and the L level in the period T1, the transfer gate 234*a* is turned on, and the transfer gate 234*b* is turned off. For this reason, the trapezoidal waveform Adp1 of the driving signal COM-A is selected in the period T1, and subsequently, the trapezoidal waveform Bdp2 of the driving signal COM-B is selected, since the selection signals Sa and Sb are set to the L level and the H level in the period T2.

Accordingly, inks of a moderated amount and of a small amount are ejected from a nozzle by being divided into two. For this reason, each ink lands on the printing medium P, and unites, and as a result, a middle dot which is defined in the printing data SI is formed on the printing medium.

When the printing data SI is (1, 0), since the selection signals Sa and Sb are set to the L level together in the period T1, the transfer gates 234*a* and 234*b* are turned off. For this reason, neither the trapezoidal waveform Adp1 nor the trapezoidal waveform Bdp1 is selected in the period T1. When both the transfer gates 234*a* and 234*b* are turned off, a flow path from a connection point of output ends of the transfer gates 234*a* and 234*b* to one end of a piezoelectric element Pzt enters a state of high impedance which is not electrically connected to any portion. However, at both ends of the piezoelectric element Pzt, a voltage ($Vc-V_{BS}$) which is a voltage prior to turning off of the transfer gate is held due to the own capacity.

Subsequently, since the selection signals Sa and Sb are set to the L level and the H level in the period T2, the trapezoidal waveform Bdp2 of the driving signal COM-B is selected. For this reason, since a small amount of ink is ejected in the period T2, a small dot which is defined in the printing data SI is formed on the printing medium P.

When the printing data SI is (0, 0), since the selection signals Sa and Sb are set to the L level and the H level in the period T1, the transfer gate 234*a* is turned off, and the transfer gate 234*b* is turned on. For this reason, the trapezoidal waveform Bdp1 of the driving signal COM-B is selected in the period T1. Subsequently, since the selection signals Sa and Sb are set to the L level together in the period T2, neither the trapezoidal waveform Adp2 nor the trapezoidal waveform Bdp2 is selected.

For this reason, in the period T1, since ink in the vicinity of the opening portion of the nozzle N merely vibrates, minutely, and ink is not ejected, as a result, a dot is not formed. That is, it becomes non-recording as defined in the printing data SI.

In this manner, the selection unit 230 selects (or does not select) the driving signals COM-A and COM-B according to an instruction from the selection control unit 210, and supplies the signals to one end of the piezoelectric element Pzt. For this reason, each piezoelectric element Pzt is driven according to a size of a dot which is defined in the printing data SI.

In addition, the driving signals COM-A and COM-B which are illustrated in FIG. 10 are merely examples. In practice, a combination of various waveforms which is prepared in advance is used according to a property, a transport speed, or the like, of a printing medium P.

In addition, here, the example in which the piezoelectric element Pzt is bent upward along with a drop of a voltage has been described; however, when voltages which are applied to the electrodes 72 and 76 are reversed, the piezoelectric element Pzt is bent upward along with a rise in voltage. For this reason, in a configuration in which the piezoelectric element Pzt is bent upward along with a rise in voltage, the driving signals COM-A and COM-B which are illustrated in the figure have waveforms which are reversed based on the voltage Vc.

According to the embodiment, to each of the liquid ejecting unit U in the liquid ejecting module 20, an analog driving signal, or the like, of approximately 42 voltages is supplied from the upstream side in the transport direction of the printing medium P through the relay substrate 160, and a digital clock signal Sck, or the like, of approximately 3. 3 voltages is supplied from the downstream side in the transport direction through the aggregate substrate 170. For this reason, since a driving signal, or the like, with large amplitude, and a clock signal Sck, or the like, with low amplitude are transmitted in a separated state until the signals reach the liquid ejecting module 20 which is a supply destination, an interference of noise associated with a change in voltage (for example, malfunction due to influence of change in voltage of driving signal with large amplitude on logic of clock signal, or the like, with low amplitude) is suppressed.

In addition, a configuration in which the driving signal, or the like, is supplied to the printing medium P from the downstream side in the transport direction by switching supply directions of the driving signal, or the like, and the clock signal, or the like, with respect to the liquid ejecting unit U, and the clock signal Sck, or the like, is supplied from the upstream side in the transport direction may be adopted.

What is claimed is:

1. A liquid ejecting apparatus comprising:

a liquid ejector that has an ejector for ejecting the liquid;

a first wiring that transmits a driving signal for driving the ejector to the liquid ejector;

a first connector that is provided in the liquid ejector, and electrically connects the first wiring;

a second wiring that transmits an ejecting control signal for controlling a supply of the driving signal to the ejector to the liquid ejector; and a second connector that is provided in the liquid ejector, and electrically connects the second wiring, wherein the liquid ejector is located between the first connector and the second connector, and the first wiring transmits the driving signal and the second wiring transmits the ejecting control signal separately.

2. The liquid ejecting apparatus according to claim 1, further comprising:

at least one of a first substrate that relays the first wiring and a second substrate that relays the second wiring.

3. The liquid ejecting apparatus according to claim 2, further comprising:

a plurality of the liquid ejectors, wherein the first substrate supplies the driving signal to each of the plurality of liquid ejectors.

4. The liquid ejecting apparatus according to claim 2, further comprising:

a plurality of the liquid ejectors, wherein the second substrate includes a distributor that separates multiplexed ejecting control signals, and distributes the ejecting control signals to each of the plurality of liquid ejectors.

5. The liquid ejecting apparatus according to claim 2, further comprising:

a controller that outputs a differential signal in which the ejecting control signal is converted, wherein the second substrate includes a receiver that receives the differential signal, and inversely converts the differential signal into the ejecting control signal.

6. The liquid ejecting apparatus according to claim 1, further comprising:

a controller that outputs a differential signal in which the ejecting control signal is converted, and a receiver that receives the differential signal, and inversely converts the differential signal into the ejecting control signal.

7. A liquid ejecting module comprising:

a liquid ejector which has an ejector for ejecting liquid;

a first wiring that transmits a driving signal for driving the ejector to the liquid ejector;

a first connector that is provided in the liquid ejector, and electrically connects the first wiring;

a second wiring that transmits an ejecting control signal for controlling a supply of the driving signal to the ejector to the liquid ejector ; and a second connector that is provided in the liquid ejector, and electrically connects the second wiring, wherein the liquid ejector is located between the first connector and the second connector, and the first wiring transmits the driving signal and the second wiring transmits the ejecting control signal separately.

8. The liquid ejecting module according to claim 7, further comprising:

a controller that outputs a differential signal in which the ejecting control signal is converted, and a receiver that receives the differential signal, and inversely converts the differential signal into the ejecting control signal.

* * * * *